United States Patent [19]

Graham et al.

[11] Patent Number: 4,691,838

[45] Date of Patent: Sep. 8, 1987

[54] PAINT CONTAINERS

[75] Inventors: Thomas Graham, Clitheroe; Leslie A. Perrins, Blackburn; Kevin Morris, Bury, all of England

[73] Assignee: Reed International plc, London, England

[21] Appl. No.: 681,317

[22] Filed: Dec. 13, 1984

[30] Foreign Application Priority Data

Dec. 16, 1983 [GB] United Kingdom ..... 8333664
Aug. 31, 1984 [GB] United Kingdom ..... 8422049

[51] Int. Cl.[4] ..... B44D 3/12
[52] U.S. Cl. ..... 220/93; 15/257.06
[58] Field of Search ..... 220/93; 15/257.05, 257.06, 15/257.072

[56] References Cited

U.S. PATENT DOCUMENTS

| | | | |
|---|---|---|---|
| 344,447 | 6/1886 | Johnston | 220/93 |
| 968,752 | 8/1910 | Ellis | 220/93 |
| 1,938,904 | 12/1933 | Harris | 15/257.06 |
| 2,779,960 | 2/1957 | Ogren | 15/257.06 |
| 2,977,624 | 4/1961 | Tarr | 15/257.06 |
| 2,994,901 | 8/1961 | Ely | 15/257.05 |
| 3,011,682 | 12/1961 | Kus | 222/105 |
| 3,139,646 | 7/1964 | Vernon | 15/257.06 |
| 3,761,995 | 10/1973 | Rinard | 15/257.06 |

FOREIGN PATENT DOCUMENTS

| | | | |
|---|---|---|---|
| 1039419 | 9/1958 | Fed. Rep. of Germany . | |
| 534349 | 10/1955 | Italy | 15/257.05 |
| 735095 | 11/1953 | United Kingdom | 15/257.05 |

*Primary Examiner*—Steven M. Pollard
*Attorney, Agent, or Firm*—William R. Hinds

[57] ABSTRACT

Paint is contained in a rectangular tray (10) and has provided at its surface a flexible membrane (13) having multiple openings (17), preferably of at least 5 mm mean transverse dimension. Paint is removed from the tray by sweeping the membrane with an applicator such as a roller. The membrane remains on the surface of the paint as paint is consumed. Preferably the membrane has (FIG. 5) the openings (17) confined to a broad central band with narrow imperforate marginal bands (51). The openings (17) lie in lines, or a matrix, which are inclined to the side walls (11) of the tray and which have apparent overlap when viewed along the membrane. The edges of the membrane may be downturned (FIG. 8) to form a paint reservoir for supplementary brushwork. The membrane may be sealed into the mouth (91) of a flexible bag (98) which is filled with paint.

3 Claims, 13 Drawing Figures

PAINT CONTAINERS

This invention relates to paint containers.

BACKGROUND OF THE INVENTION

Paint presented in a flat container at the point of sale has the advantages that it is immediately ready for use by pad or roller applicator. However, if popular forms of paint are handled in this way problems arise, depending on the nature of the paint, such as: the paint can easily be spilt; a roller applied to the paint would enter it too deeply; a large surface area is exposed which would create a large film when stored after partial use; limitations are imposed on storage and transport which would have to be more strictly observed than in the case of common cylindrical can with a lifting handle. In one way of meeting these problems, the paint can be specially formulated so that it is highly structured (nominally solid) but responds to shear at its surface to create a liquid phase of shallow depth which does not readily relax back into a solid state (see for example U.S. Pat. No. 4,304,693). With such compositions it is necessary to control the rheology and gel structure very closely since these factors have a major influence on how easily the paint is transferred to a roller. Additionally, if the structure of the paint changes, such as surface cracks appear, then there is a tendency for a roller to pick up clumps of paint which can fly off the roller during application.

The object of the present invention is to provide paint, or rheologically similar material such as adhesives, in a flat container which can be swept with a roller applicator without necessarily resorting to nominally solid formulations whilst reducing or avoiding the problems stated above.

FEATURES AND ASPECTS OF THE INVENTION

In accordance with the invention, there is provided, in combination, a flat nominally rectangular container having side walls and containing structured paint of non-pouring consistency, the paint supporting at its surface a non-flaccid, flexible membrane formed with multiple openings of mean transverse dimension greater than 5 mm through which the paint can pass when the membrane is swept by a roller-applicator, the membrane being constructed and arranged such that it can follow the fall of the surface of the paint as it is consumed, the degree of structure of the paint relative to the size of the membrane openings being such that the paint passes through the openings by extrusion and presents itself as extruded reliefs of structured paint at the openings in the membrane to give the roller-applicator an application of structured paint reliefs corresponding to the pattern of the multiple openings while the membrane still remains supported by the paint surface at at least points other than in the vicinity of the roller, the membrane flexing from the pressure of the roller-applicator as it sweeps the membrane surface, the flexing causing the paint to extrude through the membrane openings and the membrane returning to a substantially unflexed state upon removal of the roller-applicator pressure.

Also in accordance with the invention, at least partly structured paint of non-pouring consistency is presented in a flat nominally rectangular container having side walls, the paint supporting at its surface a non-flaccid, flexible membrane with multiple openings of mean transverse dimension greater than 5 mm through which the paint can pass when the membrane is swept by a roller-applicator and having, taken with the paint, these features: (a) the membrane allows paint to pass through the openings by extrusion so that the paint presents itself as extruded reliefs of structured paint at the openings in the membrane to give the roller-applicator an application of structured paint reliefs corresponding to the pattern of the multiple openings while the membrane still remains supported by the paint surface at at least points other than in the vicinity of the roller, the membrane flexing from the pressure of the roller-applicator as it sweeps the membrane surface, the flexing causing the paint to extrude through the membrane openings and the membrane returning to a substantially unflexed state upon removal of the roller applicator pressure, and (b) the membrane can follow the fall of the surface of the paint as it is consumed.

Also in accordance with the invention, structured paint of non-pouring consistency is presented in a flat nominally rectangular container having side walls, the paint supporting at its surface a membrane with multiple openings of mean transverse dimension greater than 5 mm lying in lines which are inclined to the side walls, through which openings the paint can pass when the membrane is swept by a roller-applicator, and having, taken with the paint, these features: (a) the membrane is non-flaccid but flexible to allow paint to pass through the openings by extrusion so that when the roller-applicator sweeps the membrane surface the paint presents itself as extruded reliefs of structured paint at the openings in the membrane to give the roller-applicator an application of structured paint reliefs while the membrane still remains supported by the paint surface at at least points other than in the vicinity of the roller-applicator, the membrane flexing from the pressure of the roller-applicator as it sweeps the membrane surface, the flexing causing the paint to extrude through the membrane openings and the membrane returning to a substantially unflexed state upon removal of the roller-applicator pressure, and (b) the membrane can follow the fall of the surface of the paint as it is consumed.

As used herein, the term paint includes rheologically similar material.

Preferably the membrane has a broad band occupied by said multiple openings and a narrow marginal band which has no perforations through which paint can pass to reach the sweep of the roller applicator. The marginal band may exist on a pair of opposite sides of the membrane or all round the membrane. In the latter case it is of advantage if the length and breadth dimensions of the membrane are in accordance with the two recognised standard roller lengths (approximately 18 and 23 cms) so that the membrane may be swept in its length dimension by a narrow roller and in its width dimension by a wider roller. The aggregate of the width of the broad band and a fraction of the dimensions of the narrow bands is chosen to equal the roller length. In this way the roller does not pick up paint to any great extent at its ends and hence makes for cleaner and easier application of a uniform paint film.

The narrow bands may be wholly or partly bent downwards so as to form a gulley in which paint can be collected to provide a small reservoir for material pickup by a brush. The narrow bands may also be provided with perforations (which, of course, are not swept by the roller applicator) so that an adequate reservoir of material builds up in the gulley.

The gulley has three functions: it removes paint pushed to the edges of the membrane by action of the roller; it provides the reservoir already referred to; and it improves the rigidity of the membrane and hence allows the membrane to be made of materials otherwise thought to be too flexible.

Application of a uniform film is significantly aided by arranging for the openings of the membrane to lay in lines (or a matrix) which are inclined to the side walls of the container and which have an apparent overlap when viewed along the membrane surface in the direction taken by the roller. It then becomes possible to take paint on to the roller on the forward sweep (where applied pressure tends to be greater) as repetitive reliefs each having fractions of apparent overlap with adjacent reliefs when sighted over the roller surface. On the reverse sweep (where applied pressure tends to be lower) a uniform paint film appears on the roller as the reliefs are unlikely to be in exact register with the openings.

One of the important advantages of the invention is that it allows for wide changes in structure of the paint, such as occur in normal production of emulsion paints, etc., without rendering the whole system poorly workable. For example, when used with a nominally solid paint in which cracks have developed, the presence of the cracks does not cause clumps of paint to appear on the roller.

The invention also allows a wide variety of paints of known formulation (and other materials such as adhesives) to be used and there is no vital call to formulate a paint, such as a solid paint, specifically structured to accord with the overall system.

Potentially the invention has application over a wide spectrum from viscous liquid, semi-solid, and soft gel substances (in certain cases the membrane may have to be rendered just buoyant) to solid substances which, when the surface is sheared, provides a liquid phase. One of the invention's prime applications is to partly structured emulsion paints of a non-pouring consistency.

The membrane may be of plastics, coated or impregnated board, or metal material. The flexibility will be chosen to relate to the paint below its surface. For example, for use with nominally solid paints the flexibility should be higher than with soft non-pourable paints such as the emulsion paint known as "CROWN PLUS TWO SILK" (Crown Decorative Products Limited). A precise flexibility is not usually required.

The openings may take a variety of shapes. Shapes which have been successfully tried are round, rhomboidal, and "stretched" hexagon. Generally, large openings (that is with a mean transverse dimension larger than 5 mm) are preferred to small openings (such as 1 mm) as provided, for example, by a woven mesh. Slit openings could be used.

There are a number of factors to be considered in membrane design such as thickness and material, shape of openings, percentage of area of membrane occupied by openings, width of membrane between openings and rheology of paint but, in general, these factors do not impose critical design problems as there are good tolerances allowable to provide a user-satisfactory product.

It is found that the invention overcomes the problem of "roller-biassing" that exists with the known roller applicator systems involving paint poured into a tray. In such systems the roller, when introduced into the paint, takes up paint heavily and this biasses the roller so that it fails to rotate fully as the roller is pushed along the paint in the tray. There is then slip and a tendency for the user to apply extra force so that the position is aggravated and paint is taken up yet more unevenly on to the roller and there is difficulty in making the roller rotate as the paint is applied. This gives uneven application. With the invention the roller takes up paint progressively and uniformly without significant slip so that there is no tendency for the user to apply extra force in an attempt to overcome any slip. This further assists uniform take-up and application. Where marginal imperforate bands are provided on the membrane, the bands do not become heavily coated with paint.

DESCRIPTION OF THE DRAWINGS

The invention in various specific forms will now be described further with reference to the accompanying drawings in which.

DESCRIPTION OF THE PREFERRED EMBODIMENTS

Figure 1:
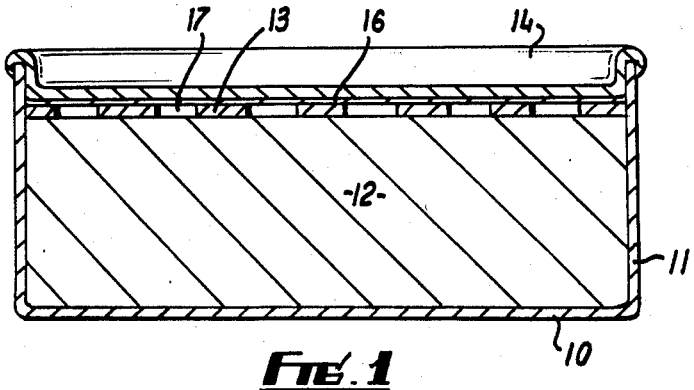
FIG. 1 is a sectional view of one form of filled paint container according to the invention.

In FIG. 1 a paint container is in the form of a rectangular plastics tray 10 with nominally vertical side walls 11. The tray is filled with paint 12 which is covered by a membrane 13. A close fitting lid 14 is included and the tray is covered by a removable foil 16 which is heat-sealed at its edges to the tray. The membrane has multiple openings 17.

In use the lid 14 and foil 16 are removed and the paint is then ready for immediate use by roller applicator of long or short haired variety (a brush or pad could also be used). The roller is chosen to be slightly wider than the broad band of the membrane 13 occupied by the openings 17.

Figure 3:
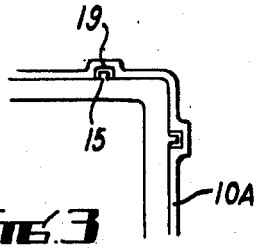
FIG. 3 is a fragmentary plan view of a corner of a container according to the invention.

In FIG. 3 a modified tray 10A and membrane are shown. The tray has vertical grooves 19 and the membrane has tongues 15. The tongues 15 and grooves 19 coupled with a close fit of the membrane in the tray inhibit any tendency for the membrane to tilt when a force is applied at one end whilst allowing it to follow the surface of the paint downwards as it is consumed. In one alternative design (see FIG. 5) neither tongues nor grooves are provided. In another design the tray could have tongues and the membrane have recesses. In all designs the membrane need not be provided in the tray at the point of sale. It could be separated from the tray at this point and placed in the tray by the user.

If the container has to be put aside before all the paint has been consumed a moist pad can be placed on the membrane 13, or the foil 16 replaced, and the lid applied.

The paint 12 could be substituted by a wallcovering pasting adhesive which would be a very convenient way of pasting a wall prior to covering with a "paste-the-wall" wallcovering.

Figure 5:
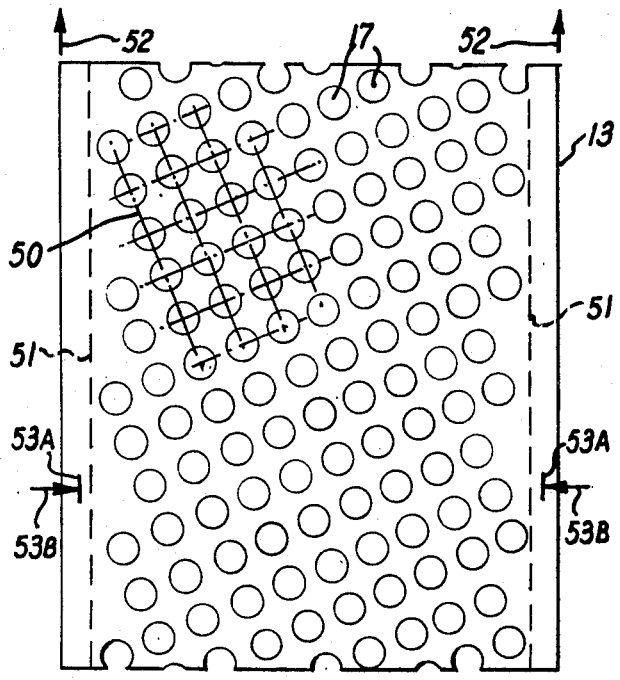
FIG. 5 is a plan view of a part of one form of membrane for use in the invention.

The membrane 13 shown in FIG. 5 has overall dimensions of 27.8 cms×23.3 cms. The openings 17 are circular and of 1.6 m diameter at 2.2 centres. The openings are located with their centres at the intersecting points of a rectangular matrix 50 having a tilt of $22\frac{1}{2}°$ relative to the edge of the membrane. The membrane is made of polyvinyl chloride of 3.0 mm thickness providing an open area of 37%. The paint used below the membrane is typically "CROWN PLUS TWO EMULSION PAINT (SILK)", (a current widely marketed paint). A 21 cm roller is used.

The membrane has imperforate marginal bands 51 each of 3.0 cm width. The direction of forward rolling is indicated by the arrows 52. The width of roller is indicated by marks 53A and arrows 53B.

Figure 5A:
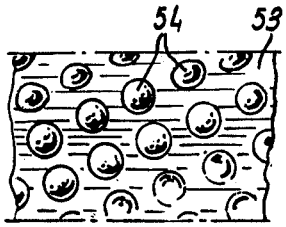
FIG. 5A is an elevation of a roller applicator which has moved in a forward pass over the membrane of FIG. 5.
Figure 5B:
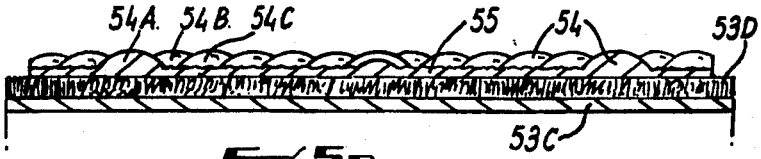
FIG. 5B is a sectional enlarged view taken across the edge of the roller of FIG. 5A assuming the surface of the roller has been laid out flat.

In FIG. 5A a roller 53 which has been taken over the membrane 13 to pick up paint is shown having the paint presented as reliefs 54. This is emphasised in FIG. 5B which shows the body 53C of the roller, a hair covering 53D, a thin all-over coating 55 of paint and the reliefs 54. It is to be observed from FIG. 5B that adjacent reliefs (such as 54A, 54B and 54C) apparently overlap one another in the given direction of viewing. Whilst this is probably not essential it is very much preferred as it gives a uniform application of reliefs on the forward stroke of the roller which flatten out to give a uniform film on the return stroke of the roller as, on the return stroke, the reliefs are no longer in register with the openings in the membrane.

Figure 6:
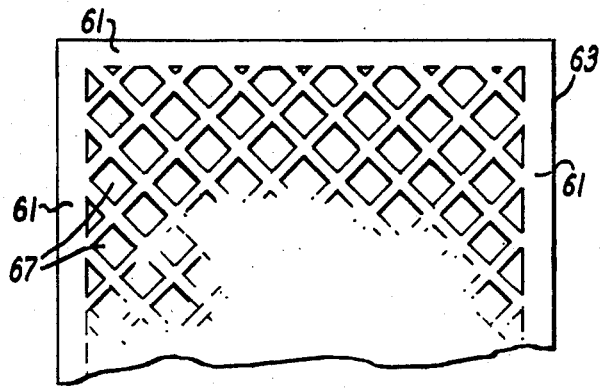
FIG. 6 is a plan view of a part of another form of membrane according to the invention.

In FIG. 6 a membrane 63 has an alternative perforation to give openings 67 of "overlapping" diamonds or rhomboids. Again there is an imperforate marginal part 61 which exists at all edges of the membrane.

Figure 7:
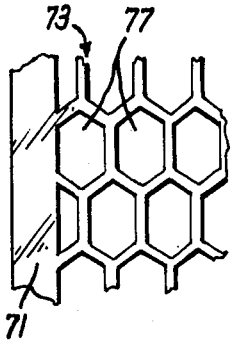
FIG. 7 is a plan view of a part of a part of yet another form of membrane according to the invention.

In FIG. 7 a membrane 73 has openings 77 of stretched hexagon shape and imperforate marginal part 71. Other shapes of openings in the membranes are possible such as oval, polygons, individually or in combination. Expanded metal could be used as a membrane.

The flexibility of the membrane may vary as between the longitudinal and lateral directions. Where the flexibility does so vary the membranes are preferably used so that the greater stiffness exists in the lateral direction. A measure of selection should be made when flexibility has to be considered for a specific paint. If the membrane is too flexible for the paint then too much paint will come onto the roller. If the membrane is too stiff then unnecessary effort is required to bring paint onto the roller. Where a membrane is intended for use with a short roller in one direction and a long roller in the other, substantially equality of flexibility in both directions is sought. Where the membrane does not inherently provide this it can be imposed by stiffening ridges.

Figure 4:
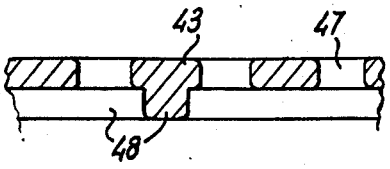
FIG. 4 is a fragmentary sectional elevation of a membrane which could be used in lieu of the membrane shown in FIG. 1.

This is shown in FIG. 4 where a membrane 43 with openings 47 has ridges 48. As the membrane falls with the consumption of paint the ridges can enter corresponding recesses in the base of the tray. This is additionally advantageous as the ridge-accommodating recesses in the base give strength to the base of the container.

Figure 2:
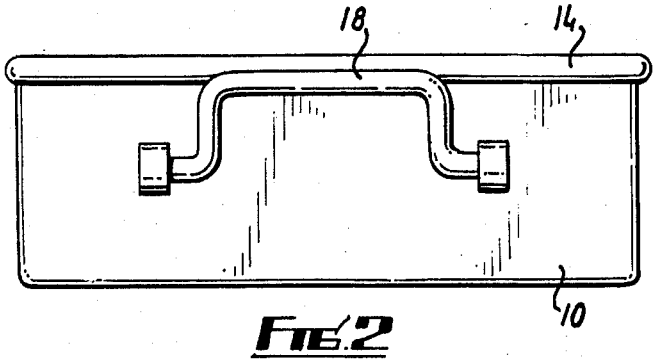
FIG. 2 is an end view of the container of FIG. 1.

In FIG. 2 the external appearance of the container is shown. The tray 10 is provided with a handle 18.

Figure 8:
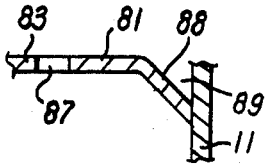
FIG. 8 is a fragmentary sectional elevation of a membrane with a down-turned edge.

In FIG. 8 a membrane 83 with openings 87 has a narrow marginal band 81 with a downturned part 88 which forms, with the wall 11 of the tray, a gulley 89. Paint is encouraged to enter the gulley either by drainage from the surface of the membrane 83 or with slits or small openings in the part 88, by paint rising through the downturned part. Paint in the gulley can be used for brush-work in places where a roller does not reach.

Figure 9:
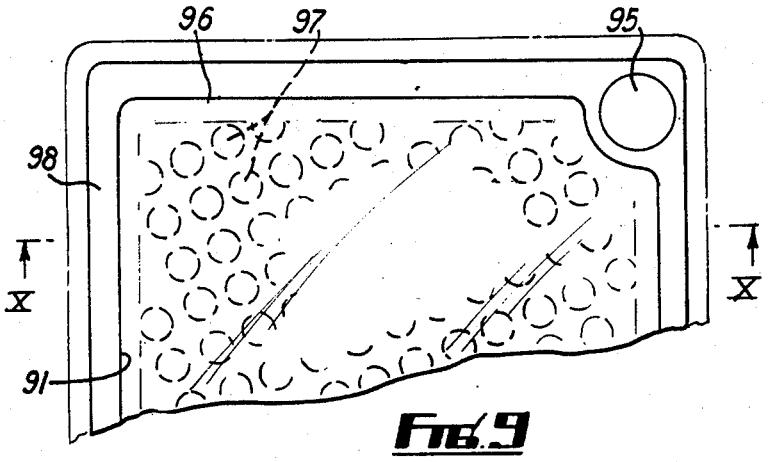
FIG. 9 is a plan view of a membrane having a paint holding bag secured to it.
Figure 10:
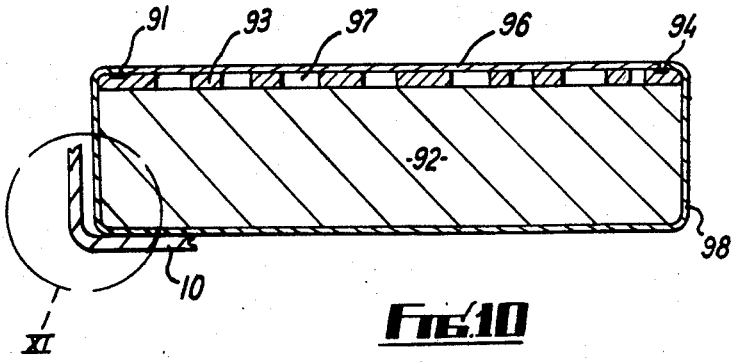
FIG. 10 is a sectional view on the line $\overline{X}$—$\overline{X}$ of FIG. 9.

FIGS. 9 and 10 introduce the concepts of paint 92 in a flexible bag 98 supported in the tray 10. The bag has a large mouth 91 across which a membrane 93 having openings 97 is sealed at a seal 94. The openings in the membrane are sealed with a foil 96. A sealed filling aperture 95 for the bag 98 is shown.

Figure 11:
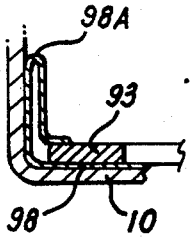
FIG. 11 is a fragment of the section of FIG. 10 when the paint in the container has been consumed.

In FIG. 11 the membrane 93 is shown at the base of bag 98. All the paint has been consumed and the walls of the bag 98 have folded (see fold 98A).

We claim:

1. Structured paint of non-pouring consistency presented in a flat nominally rectangular container having side walls, the paint supporting at its surface a membrane with multiple openings of mean transverse dimension greater than 5 mm lying in lines which are inclined to said side walls through which openings the paint can pass when the membrane is swept by a roller-applicator and having, taken with the paint, these features:

(a) the membrane is non-flaccid but flexible to allow paint to pass through the openings by extrusion so that when the roller-applicator sweeps the membrane surface the paint presents itself as extruded reliefs of structured paint at the openings in the membrane to give the roller-applicator an application of structured paint reliefs while the membrane still remains supported by the paint surface at at least points other than in the vicinity of the roller-applicator, the membrane flexing from the pressure of the rollerapplicator as it sweeps the membrane surface, the flexing causing the paint to extrude through the membrane openings and the membrane returning to a substantially unflexed state upon removal of the roller-applicator pressure, and (b) the membrane can follow the fall of the surface of the paint as it is consumed.

2. At least partly structured paint of non-pouring consistency presented in a flat nominally rectangular container having side walls, the paint supporting at its surface a non-flaccid, flexible membrane with multiple openings of mean transverse dimension greater than 5 mm through which the paint can pass when the membrane is swept by a roller-applicator and having, taken with the paint, these features:

(a) the membrane allows paint to pass through the openings by extrusion so that the paint presents itself as extruded reliefs of structured paint at the openings in the membrane to give the roller-applicator an application of structured paint reliefs corresponding to the pattern of the multiple openings while the membrane still remains supported by the paint surface at at least points other than in the vicinity of the roller, the membrane flexing from the pressure of the roller-applicator as it sweeps the membrane surface, the flexing causing the paint to extrude through the membrane openings and the membrane returning to a substantially unflexed state upon removal of the roller applicator pressure, and (b) the membrane can follow the fall of the surface of the paint as it is consumed.

3. In combination, flat nominally rectangular container having side walls and containing structured paint of non-pouring consistency, the paint supporting at its surface a non-flaccid, flexible membrane formed with multiple openings of mean transverse dimension greater than 5 mm through which the the paint can pass when the membrane is swept by a roller-applicator, the membrane being constructed and arranged such that it can follow the fall of the surface of the paint as it is consumed, the degree of structure of the paint relative to the size of the membrane openings being such that the paint passes through the openings by extrusion and presents itself as extruded reliefs of structured paint at the openings in the membrane to give the roller-applicator an application of structured paint reliefs corresponding to the pattern of the multiple openings while the membrane still remains supported by the paint surface at at least points other than in the vicinity of the roller, the membrane flexing from the pressure of the roller-applicator as it sweeps the membrane surface, the flexing causing the paint to extrude through the membrane openings and the membrane returning to a substantially unflexed state upon removal of the roller-applicator pressure.

* * * * *